US009439457B2

(12) United States Patent
Baravarian

(10) Patent No.: US 9,439,457 B2
(45) Date of Patent: Sep. 13, 2016

(54) ARCH-SUPPORTING SOCK

(71) Applicant: Babak Baravarian, Beverly Hills, CA (US)

(72) Inventor: Babak Baravarian, Beverly Hills, CA (US)

(73) Assignee: SOKSYSTEM, LLC, Beverly Hills, CA (US)

( * ) Notice: Subject to any disclaimer, the term of this patent is extended or adjusted under 35 U.S.C. 154(b) by 270 days.

(21) Appl. No.: 14/161,632

(22) Filed: Jan. 22, 2014

(65) Prior Publication Data

US 2015/0201703 A1 Jul. 23, 2015

(51) Int. Cl.
*A41B 11/00* (2006.01)
*A41B 11/02* (2006.01)

(52) U.S. Cl.
CPC ..... *A41B 11/003* (2013.01); *A41B 11/02* (2013.01)

(58) Field of Classification Search
CPC ..... A41B 11/003; A41B 11/02
USPC ..... 2/239–241; 66/182, 185–187
See application file for complete search history.

(56) References Cited

U.S. PATENT DOCUMENTS 2,144,563 A 1/1939 Davis
4,255,949 A 3/1981 Thorneburg
4,277,959 A 7/1981 Thorneburg
4,520,635 A 6/1985 Shields et al.
5,771,495 A 6/1998 Turner et al.
5,784,721 A * 7/1998 Huff ..... 2/239
6,012,177 A 1/2000 Cortinovis
6,324,874 B2 12/2001 Fujimoto
6,668,387 B2 12/2003 Kalde
7,007,517 B2 3/2006 Menzies
7,441,419 B1 * 10/2008 Dollyhite et al. ..... 66/178 A
7,677,061 B2 3/2010 Mori et al.
8,424,117 B2 4/2013 Hasan et al.
2009/0095026 A1 * 4/2009 Araki et al. ..... 66/187
2014/0053610 A1 * 2/2014 Fukui ..... 66/183

* cited by examiner

*Primary Examiner* — Khaled Annis
(74) *Attorney, Agent, or Firm* — Jafari Law Group, Inc.

(57) ABSTRACT

The present invention relates generally to an arch-supporting sock in which proper curvature of the arch is reinforced and strain on the leg, arch, and greater foot area is decreased, comprising a first region having a first elasticity coefficient and a second region, roughly encompassing the arch of the foot, having a second elasticity coefficient, wherein the second region provides greater structural support than the first region and the second elasticity coefficient is lower than the first elasticity coefficient. The arch-supporting sock may further comprise one or more perimetric boundaries between the first and the second region, each boundary comprising a perimetric elasticity coefficient, wherein one or more perimetric boundaries has a perimetric elasticity coefficient less than the first and second elasticity coefficients. Embodiments of the sock include non-interchangeable left or right socks with the arch support assemblage residing on the inner half of the sock.

12 Claims, 6 Drawing Sheets

ARCH-SUPPORTING SOCK

TECHNICAL FIELD OF THE INVENTION

The present invention relates in general to an arch-supporting sock, and more specifically, to a sock which provides additional support and stability to the arch of the foot in order to reinforce proper curvature of the arch and decrease strain in the leg, arch, and greater foot area.

BACKGROUND OF THE INVENTION

For centuries, stockings or socks have been used to provide comfort and warmth and protect the feet from cracking, dryness, chafing, or general damage that can result from continually rubbing up against one's footwear or, if barefoot, the surrounding environment. More recently, sock entrepreneurs have especially begun focusing on the comfort aspect of sock wearing, for example designing thinner socks that allow for greater airflow or thicker socks that provide greater padding. Thicker socks often employ terry loops to provide greater moisture absorption in addition to increased cushioning. Some prior art has employed terry loops only in particular areas of the sock or simply with greater density in those areas so as to soften the impact of the foot as it makes contact with the ground while walking or otherwise mobile on foot. Prior art has taken this approach with many areas of the foot, including the Achilles tendon, sole, heel, and toes, but seldom the arch or the arch side of the foot. Yet among the enumerated, the arch is of great importance.

The arch region principally resides in the inner-middle part of each foot and is predominately comprised of or reliant on the tarsal and metatarsal bone set and various tendons and ligaments to support the weight of the entire human body when erect. Therefore, it is unsurprising that the arch undergoes immense strain and pressure, which can become quite problematic for a person, especially when the arch is not being supported sufficiently by socks or footwear. But despite its importance, the prior art neglect to solely provide support for the arch (inner) side of the foot. Moreover, the prior art emphasize cushioning to the exclusion of structural support, an important distinction with even more important consequences. While cushioning may ameliorate pain associated with walking or running, structural deficiencies are all but ignored and untreated.

Therefore, persons with, for example, plantar fasciitis or low or flat foot arches, would likely make very limited improvement by wearing cushioning socks, but could greatly benefit from socks with improved arch regions in light of the problems presented by the prior art. Hence, there is a need in the art for an arch-supporting sock, which reduces pain and strain in the arch regions of the feet and reinforces proper curvature of the arch, whereby other areas important for standing and mobility such as the heel or lower leg are positively impacted as well. It is to these ends that the present invention has been developed.

SUMMARY OF THE INVENTION

To minimize the limitations in the prior art, and to minimize other limitations that will be apparent upon reading and understanding the present specification, the present invention describes an arch-supporting sock used to reduce pain and strain in the arch region of the foot and stabilize and reinforce proper curvature of the arch.

An arch-supporting sock, in accordance with one embodiment of the present invention, comprises: a first region having a first elasticity coefficient; and a second region, roughly encompassing the arch of the foot, having a second elasticity coefficient for providing structural support, wherein the second elasticity coefficient is lower than the first elasticity coefficient.

An arch-supporting sock, in accordance with another embodiment of the present invention, comprises: a first region having a first elasticity coefficient; and a second region, roughly encompassing the arch of the foot; and one or more perimetric boundaries between the first region and the second region, each perimetric boundary comprising a perimetric elasticity coefficient, wherein at least one of the one or more perimetric boundaries has a perimetric elasticity coefficient less than the first elasticity coefficient.

An arch-supporting sock, in accordance with yet another embodiment of the present invention, comprises: a first terry loop region having a first elasticity coefficient; a second tuck-stitched region, roughly encompassing the arch of the foot, having a second elasticity coefficient for providing structural support, wherein the second elasticity coefficient is lower than the first elasticity coefficient; and one or more perimetric boundaries between the first region and the second region, each boundary comprising a perimetric elasticity coefficient, wherein the one or more perimetric boundaries have a perimetric elasticity coefficient less than the first and second elasticity coefficients.

It is an objective of the present invention to support the arch region of the foot without forfeiting comfort.

It is another objective of the present invention to provide a plurality of types of socks for different occasions and circumstances.

It is another objective of the present invention to reinforce proper curvature of the arch region.

It is yet another objective of the present invention to provide a wedge support of the inner half of the foot and thereby raise the medial longitudinal arch with respect to the outer half of the foot.

Finally, it is yet another objective of the present invention to alleviate pain and decrease strain in the heel, arch and greater foot region.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 3(*b*) is a side view of a foot with a flat arch, wherein the bottom of the arch is in contact with the ground.

FIG. 4(*b*) is a side view of a left ankle-length sock, in accordance with one embodiment of the present invention.

FIG. 5(*b*) is a side view of a left liner-length sock, in accordance with one embodiment of the present invention.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized and changes may be made without departing from the scope of the present invention.

Figure 1:
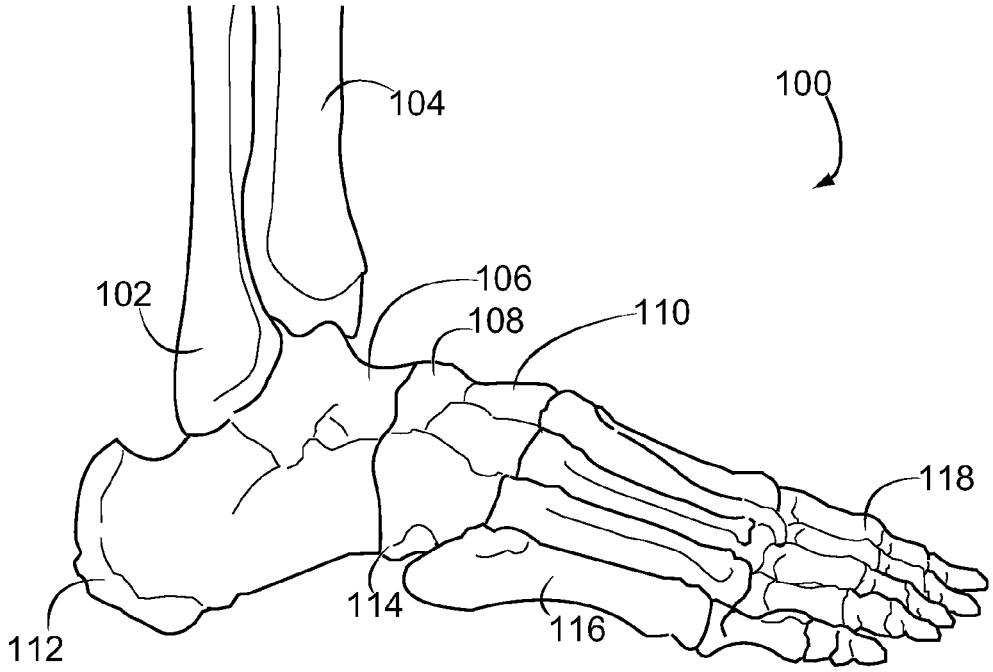
FIG. 1 is a side elevation view of the bones of the lower leg and foot.

FIG. 1 serves as an introduction to the physical features, namely the bones, which comprise the arch of the foot and other relevant foot and leg bones, so as to provide greater context and understanding to the scope and purpose of the present invention. FIG. 1 is a side view of the bones of the lower leg and foot. The relevant bones of the lower leg and foot 100 consist of talus 106, calcaneus 112, fibula 102, tibia 104, cuboid 114, navicular 108, cuneiforms 110, metatarsals 116, and phalanges 118. Calcaneus 112, talus 106, cuboid 114, navicular 108, and the three cuneiforms 110 form what is referred to as the tarsals. Only two of the three cuneiforms 110 are visible, with the third hidden cuneiform 110 residing on the line of bones ending distally with the big toe, also referred to as the hallux.

For the purposes of simplicity, the foot can also be categorized into its relative regions: the hindfoot, midfoot, and forefoot, listed from proximal to distal end. The hindfoot comprises calcaneus 112 and talus 106. The midfoot comprises five important bones, two of which are cuboid 114 and navicular 108, and three of which are cuneiforms 110, together outlining the area of interest: the arch region. The forefoot comprises metatarsals 116, which are the five bones connecting the midfoot to the toe bones, and the toe bones themselves, referred to as phalanges 118. The hallux has two phalanges 118, whereas the remaining four toes are comprised of three phalanges 118. Tibia 104 and fibula 102 do not make up part of foot 100 and are instead long bones of the lower leg, though both tibia 104 and fibula 102 impact and are impacted by the arch region and its constituents.

Figure 2:
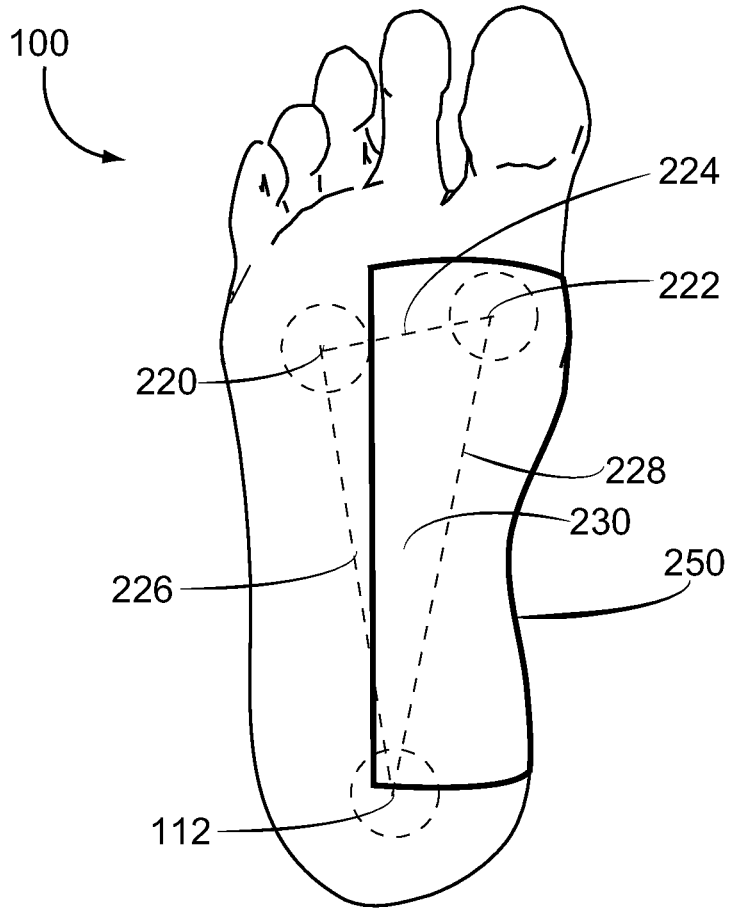
FIG. 2 is a plantar view of the underside of a human foot.

FIG. 2 is a plantar view of the underside of a foot. The figure displays the three primary arches of the human foot as well as a visual approximation of the area supported by an arch support assemblage, in accordance with an exemplary embodiment of the present invention. Medial ball 222 refers to the region on the inner part of foot 100 near the distal end of metatarsals 116 between the hallux and the adjacent long toe, wherein medial ball 222 serves as an arch base. Lateral ball 220 refers to the region on the outer part of foot 100 near the distal end of metatarsals 116 between the fifth toe and fourth toe, wherein lateral ball 220 serves as an arch base. The space between medial ball 222 and lateral ball 220, which under normal circumstances resembles an arch structure, is hereby referred to as transverse arch 224. Similarly, the region between medial ball 222 and calcaneus 112, which under normal circumstances resembles an arch structure, is hereby referred to as medial longitudinal arch 228. Also similarly, the region between lateral ball 220 and calcaneus 112, which under normal circumstances resembles an arch structure, is hereby referred to as lateral longitudinal arch 226. Medial longitudinal arch 228 is the inner-most arch of the three enumerated arches, typically receiving more intense stress than lateral longitudinal arch 226 and transverse arch 224. Thus medial longitudinal arch 228 may benefit most from an arch support assemblage lessening stress and strain on the arch region, heel, and medial and lateral balls 222, 220 of foot 100 upon impacting the ground. Furthermore, the part of the sock underlying or roughly covering medial longitudinal arch 228 may have additional material yielding a lower elasticity coefficient than some or all of the other arch supports, a concept elaborated upon in later figures.

Arch support assemblage 250, in accordance with the present exemplary embodiment displayed in FIG. 2, covers a majority of arch region 230, with medial longitudinal arch 228 entirely covered. Thus, arch support assemblage 250 will afford the greatest structural support to the inner, medial portion of foot 100. However, it is important to note that structural support is not limited to arch region 230, since arch support assemblage 250 extends beyond arch region 230. Specifically, in the present embodiment, arch support assemblage 250 extends from the center of the heel, approximated by calcaneus 112, to the end of metatarsals 116 where they reach the start of phalanges 118. Additionally, along the width of foot 100, arch support assemblage 250 reaches from the medial-most part of foot 100 to the vertical boundary between the second and third toes. The scope or area of arch support assemblage 250 may be contracted or expanded without deviating from the spirit or scope of the present invention. For instance, arch support assemblage 250 may extend widthwise to the middle of the third toe, the vertical boundary between the third and fourth toes, or the middle of the second toe to cover more or less of arch region 230. In any case, this may cause the inner or medial half of foot 100 to become slightly wedged or raised by comparison to the outer or lateral half of foot 100. The disparity in support between the inner and outer halves of the feet is representative of the disparity in strain and stress endured by each half of the foot while mobile on foot.

In alternative embodiments, arch support assemblage 250 may cover a slightly larger area of foot 100, perhaps to the vertical boundary between the third and fourth toes, so as to more completely encompass arch region 230. However, even in such wider-reaching embodiments, a disproportionate amount of support is offered to the inner half of foot 100 as compared to the outer half.

Figure 3A:
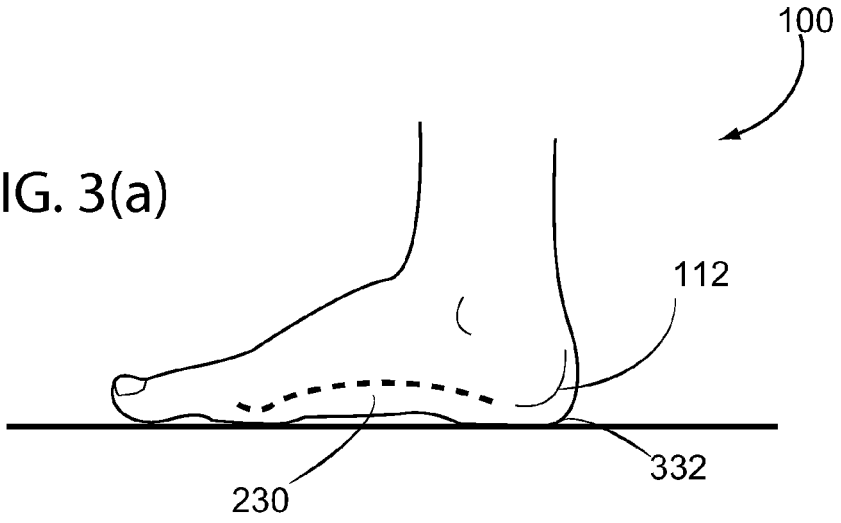
FIG. 3(*a*) is a side view of a foot with a typical arch, wherein the bottom of the arch is not in contact with the ground.
Figure 3B:
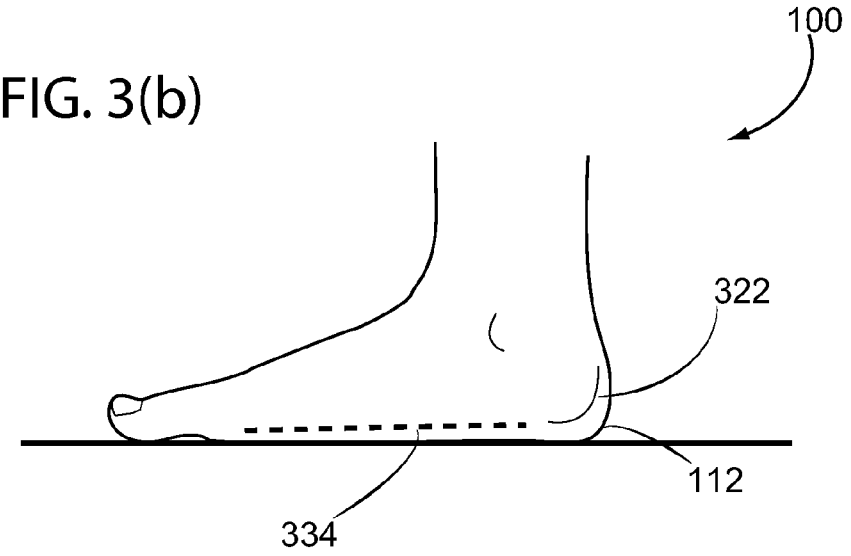

FIG. 3(*a*) is a side view of a foot with a preferable amount of medial foot matter not in contact with the ground, thus forming a normal arch. The approximate proportion and parts of the foot desired to be in contact with the ground in various instances such as when standing, walking, or running would be known by those skilled in the art. Arch region 230, as displayed in FIG. 3(*a*), is of great importance because of its elasticity. When erect, the parts of foot 100 that make up arch region 230, such as the plantar fascia, help spread and extend ground contact out over time, in the process reducing the amount of strain put on the rest of arch region 230, as well as the greater foot area and lower leg. Additionally, support of arch region 230, such as that displayed in the discussed figure, is essential for upright posture longevity. Possessing the ideal or close to the ideal curvature of arch region 230 is beneficial for storing some of the energy expended when arch region 230 begins flattening upon impacting the ground, much like a coiling spring, and using it to lessen the energy demand for the following step. This makes walking, running, standing and the like more economical actions. If this level of support is not attainable because of the curvature of the medial portion of the foot, an arch support assemblage affords twofold relief: firstly by lowering the energy demands associated with standing or moving, and secondly by reinforcing proper curvature of arch region 230, thereby assisting arch region 230 in reusing energy expended in flattening the arch for impact with the ground.

As a result of the lowered energy demand for erect posture and movement, an arch support assemblage is also useful for persons with normal foot arches. While foot maladies are more likely to occur among those with structural difficulties or deficiencies in the foot or leg, they also occur in persons with no such difficulties or deficiencies, for example when beginning a more rigorous exercise regimen or running long distances on pavement or concrete. Furthermore, such difficulties as flat feet, elaborated upon in the discussion of FIG. 3(*b*), often develop gradually from slow wear and tear of the tendons, muscles, ligaments, and bones, or as a result of some medical conditions, such as diabetes, or diseases of the nervous system or muscular system, such as cerebral palsy or muscular dystrophy. Lastly, flat feet are known to temporarily develop in some pregnant women. In these instances, among many others, the sock disclosed in FIGS. 4-8, because of its stiff, yet comfortable nature, may help slow the onset of flat feet or, depending on the cause and circumstance, prevent flat feet altogether.

FIG. 3(*b*) is a side view of a foot with an insufficient amount of medial foot matter not in contact with the ground, thus forming a flat arch. Flat arch 334 is also commonly referred to as a fallen arch or as flat feet, and can result in a myriad of complications which may disrupt a sufferer's daily routine. For example, flat arch 334 may result in undue strain being put on calcaneus 112, heel 332, or on medial ball 222 and lateral ball 220 of foot 100. As a result of the discomfort or pain, a person may slowly alter their gait, often unknowingly, culminating then in undue stress being put on other parts of the body associated with standing, walking, or running, such as the back, Achilles tendon, toes, tibia 104, and shins. Frequently, this can lead to a number of subsequent injuries and general complications, typically soreness, inflammation, tendinitis, and fatigue, but also more directed complications such as painful shin splints or heel spurs.

Sock 436 disclosed in FIGS. 4-8, because of its stiff, yet comfortable nature, could not only help to alleviate a number of the abovementioned symptoms of flat arch 334, but also address the conformation of the foot which firstly manifests these symptoms.

Still referring to FIG. 3(*b*), flat arch 334 may decrease the functionality of the plantar fascia. The plantar fascia is an important set of thick, connective tissue, running from calcaneus 112 through metatarsals 116, which acts like a shock absorber, whereby it supports arch region 230 of foot 100 and makes manageable the immense stress and tension put on arch region 230 by the rest of the body. Upon decreasing the functionality of the plantar fascia, this tension may become too great, leading to small tears being made in the fascia, eventually resulting, in many instances, in inflammation and irritation, known as plantar fasciitis. Plantar fasciitis can cause severe pain in the heel and sole of the foot when in any foot-reliant erect posture, whether mobile or stationary, and is thus quite common in vocations such as athletics or military service. Sock 436 disclosed in FIGS. 4-8, because of its stiff, yet comfortable nature, could relieve much strain on the plantar fascia and more generally arch region 230, by delegating some of the bodily stress and pressure to the discussed arch-supporting sock 436. Thus, the described invention is useful as a treatment for plantar fasciitis or other inflammatory responses associated with insufficient support of the arch, greater foot area, or leg.

Figure 4A:
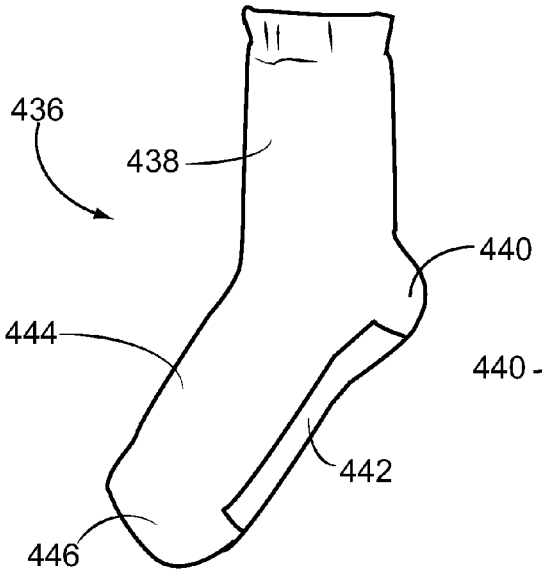
FIG. 4(*a*) is a side view of a right ankle-length sock, in accordance with one embodiment of the present invention.
Figure 4B:
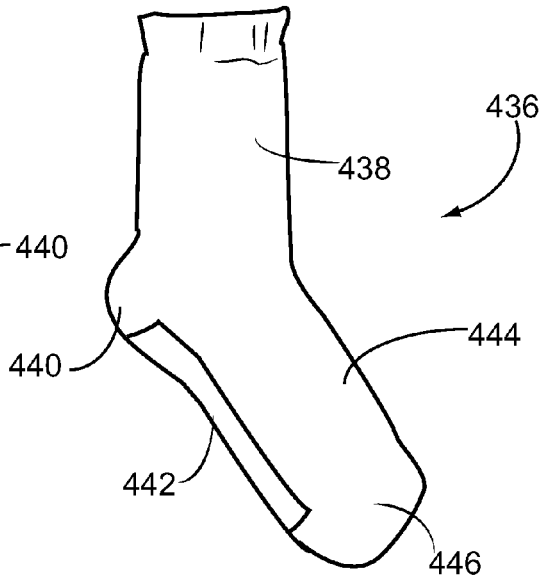

Each of the following figures describes the various parts, features, designs, and purposes of the proposed arch-supporting sock. FIG. 4(*a*) is a side view of a right ankle-length sock. Ankle-length sock 436 generally has the top of sock 436 reaching just above the ankle bone, also referred to as talus 106. Sock 436 displayed in FIG. 4(*a*) or in any other figure presents only one of many possible variations of sock designs and lengths and should not be seen as limiting or exhaustive. In this figure, sock 436 has sock leg 438, which describes the region from the opening of sock 436 until approximately the beginning of heel flap 440 in the back and instep 444 in the front. Heel flap 440 roughly encompasses heel 112 of foot 100, including the heel bone, also referred to as calcaneus 112, and can vary in weave density depending on a number of factors, such as but not limited to: sock length, style, or material.

The sock material is an important feature of the invention. The stiff, reinforcing region of the arch is not specific to a particular type of sock, and as such, can be made for any occasion, formal or informal, athletic, or otherwise. For instance, the sock may be made for the purposes of walking, running, skiing, snowboarding, working, hiking, or backpacking, though the enumerated purposes are by no means exhaustive. As a result of the various purposes wherein a person might find the invention of use, the sock can also comprise a myriad of materials. By way of just a few non-limiting examples, wool, polyester, cotton, acrylic, nylon, and cashmere may be utilized.

Sock instep 444 refers to the top region of sock 436 which overlays arch region 230 and arch support assemblage 442 but is not in contact with support assemblage 442 when foot 100 is inside sock 436. Arch support assemblage 442 rests in front of heel flap 440 and behind sock toe 446 and comprises a denser weave than the remaining regions of sock 436, although it does not employ the oft-used terry loops, as the terry loop weave is much better fit for cushioning than providing structural support and stability. Rather, in one non-limiting embodiment, arch support assemblage 442 may employ tuck stitching to achieve a denser weave in which a given sock segment may have multiple rows of stitching overlain. The proposed arch-supporting sock may employ terry loops elsewhere in the sock, where perhaps support and stability are not the goal. Accordingly, arch support assemblage 442 is stiffer than any other part of the sock, though stiffness may vary within arch support assemblage 442 due to differences in strain between parts of the arch. The arch or arch region 230, unless specified as a particular arch, such as transverse arch 224, is to be construed as the region falling on or within the confines of medial longitudinal arch 228, lateral longitudinal arch 226, and transverse arch 224.

Additionally, with reference to sock 436 of FIG. 4(*a*), arch support assemblage 442 is located on the right side of sock 436 to support arch region 230 of the foot, which endures the most stress on the inner portion of the midfoot. Arch support assemblage 442 transitions into sock toe 446, which covers the toes of the foot.

FIG. 4(*b*) is a side view of a right ankle-length sock. Sock 436 of FIG. 4(*b*) is substantially identical to that of FIG. 4(*a*) with the exception that the arch support assemblage 442 is on the left side of sock 436 to reflect the mirrored anatomy between the left and right feet.

Figure 5A:
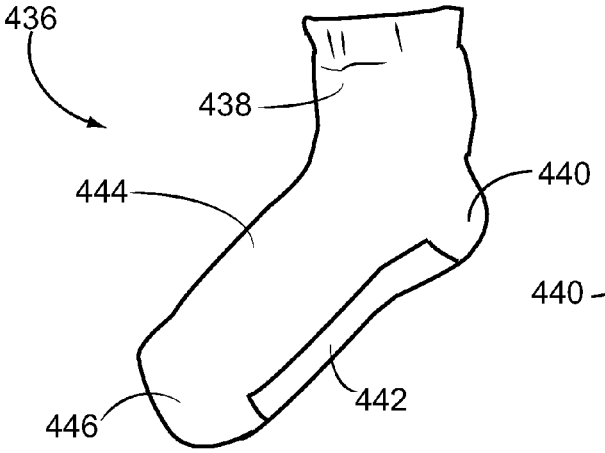
FIG. 5(*a*) is a side view of a right liner-length sock, in accordance with one embodiment of the present invention.
Figure 5B:
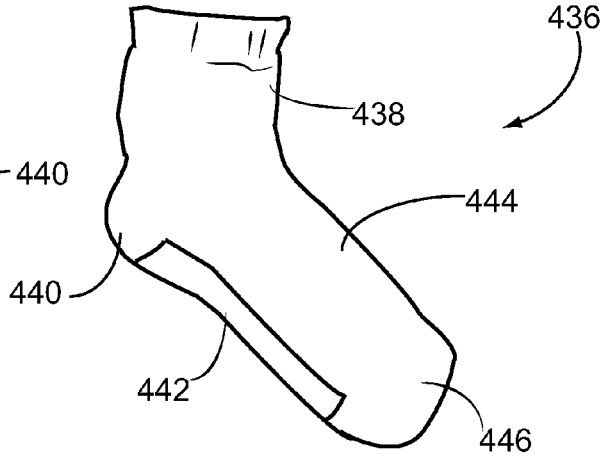

FIG. 5(*a*) is a side view of a left liner-length sock. A liner length sock 436 generally has the top of sock 436 reaching just below talus 106. In such an embodiment, sock 436, sock leg 438 is largely absent, quickly transitioning from the top of sock 436 into heel flap 440. Heel flap 440 extends to arch support assemblage 442, which itself extends to sock toe 446 roughly parallel to sock instep 444. Generally, a liner-length sock is used for athletics or walking, but is not restricted to doing so.

FIG. 5(*b*) is a side elevation view of a right liner-length sock. Sock 436 of FIG. 4 is substantially identical to that of FIG. 3 with the exception that arch support assemblage 442 is on the left side of sock 436 to reflect the mirrored anatomy between the left and right feet.

Figure 6:
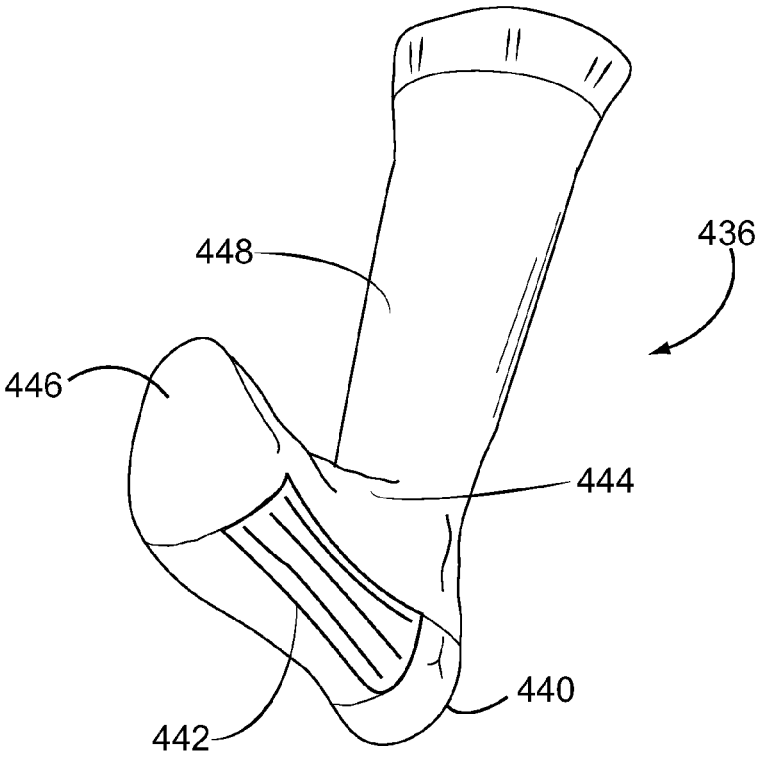
FIG. 6 is a perspective view of a right one-half knee-length sock, in accordance with one embodiment of the present invention.

FIG. 6 is a side perspective view of a one half hose-length sock. This figure better displays a sock that a user might wear in more formal circumstances or engagements, often but not exclusively work or work-related activities. By way of a non-limiting example, sock 436 may be comprised of polyester, cashmere, or nylon, especially if used as a formal or dress sock. In accordance with the present invention, this embodiment also comprises an arch support structure, namely, support assemblage 442.

Figure 7:
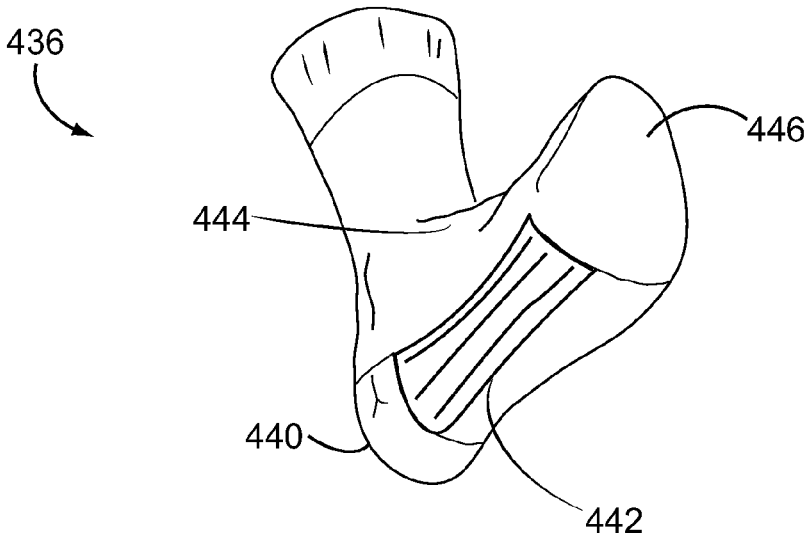
FIG. 7 is a side view of a left one-fourth knee-length sock, in accordance with one embodiment of the present invention.

FIG. 7 is a side perspective view of a one fourth hose-length sock in accordance with another embodiment of the present invention. This figure better displays a sock that a user might wear during such activities as hiking. Though not a requirement, a sock of this length will often be thicker than those of ankle, liner, or one-half length socks to provide increased insulation and protection from dampness seeping through the layers of the sock.

Figure 8:
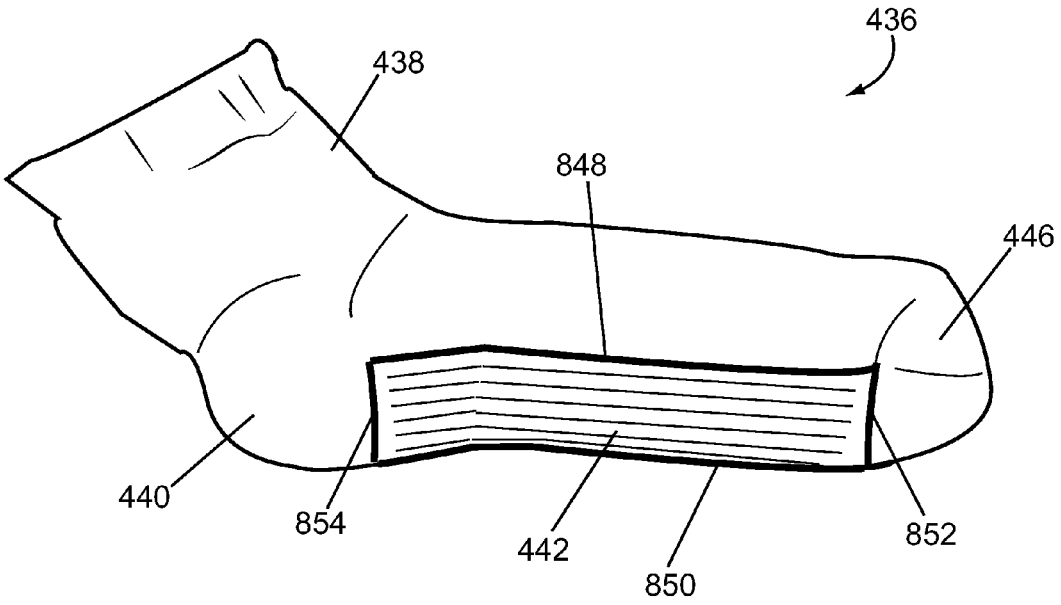
FIG. 8 depicts one embodiment of the arch support assemblage of a sock in accordance with the present invention.

FIG. 8 depicts one embodiment of the arch support assemblage in a left sock. In the pictured embodiment, arch support assemblage 442 is in the shape of a rectangle, though different shapes may exist in other embodiments without deviating from the spirit or scope of the present invention. The discussed embodiment has arch support assemblage 442 with longer sides running roughly parallel to the length of sock 436 either from heel flap 440 to sock toe 446 or vice versa, and shorter sides running perpendicular to the longer sides, the longer and shorter sides together forming a boundary perimeter between the archetypical sock features and arch support assemblage 442. The archetypical sock features are meant to be construed as those features outside of arch support assemblage 442 very frequently found in basic socks, such as heel flap 440, sock leg 438, and sock toe 446, as well as other features deemed standard or very common by those skilled in the art. Among the longer sides of arch support assemblage 442, a second perimetric boundary or medial longitudinal support 848 lies superior to a first perimetric boundary or lateral longitudinal support 850. In exemplary embodiments, medial longitudinal support 848 roughly extends along medial longitudinal arch 228. Also in exemplary embodiments, lateral longitudinal support 850 roughly extends along lateral longitudinal arch 226, at least to the extent that lateral longitudinal arch 226 is noticeably supported by lateral longitudinal support 850.

Among the shorter sides of arch support assemblage 442, with sock toe 446 considered to be the distal-most region and sock leg 438 considered the proximal-most region, a third perimetric boundary or transverse support 852 lies distal to a fourth perimetric boundary or heel support 854. In exemplary embodiments, transverse support 852 roughly extends along transverse arch 224, though other embodiments exist in which transverse support 852 is distal to transverse arch 224 and may more closely outline the boundary between the metatarsals and phalanges. Also in exemplary embodiments, heel support 854 roughly contours the distal end of heel 332 in the approximate region where the midfoot begins and hindfoot ends. Without deviating from the spirit or scope of the present invention, heel support 854 may also begin near the center of heel 332, with reference the length and not the width of sock 436. In the embodiment pictured in FIG. 8, as well as many other exemplary embodiments, the perimetric boundaries or supports that form arch support assemblage 442 are of varying elasticity coefficients.

In the present disclosure, elasticity coefficient generally refers to the ratio of acutely endured stress to the temporary change in conformation of an elastic entity, whereby for example, an entity with a low elasticity coefficient would be less flexible, pliable, or otherwise physically influenced than an entity with a high elasticity coefficient, assuming equal stress is applied.

The illustrated embodiment comprises medial longitudinal support 848, lateral longitudinal support 850, and transverse support 852 with lower elasticity coefficients than both heel support 854 and most or the rest of arch support assemblage 442 bound within the perimetric supports 848, 850, 852, 854. Parts of the arch-supporting sock having comparably lower elasticity coefficients will be more stiff and obdurate, that is resistant to physical manipulation or persuasion, and resultantly more stable and supportive of the corresponding regions of the foot resting upon these sock regions than will those parts with comparably higher elasticity coefficients. Accordingly, in these embodiments, the arch-supporting sock is able to stabilize and support the entirety of arch region 230, also referred to as the arch, as defined roughly by the dashed lines in FIG. 2, but provide even greater structural support and stability along the perimetric support boundaries where pressure is likely to be highest.

The difference of elasticity around and within the perimetric boundary of arch support assemblage 442 may be achieved in any number of ways. For example, and without limiting the scope of the present invention, arch support assemblage 442 is bound within the perimetric boundaries or perimetric supports 848, 850, 852, 854 and may comprise different knitting or stitching techniques known in the art, such as tuck-stitching, implemented in a manner so that arch support assemblage 442 comprises an increased weight, width, or thickness.

Other embodiments may comprise of perimetric supports which have elasticity coefficients less than most or the rest of sock 436. For instance, in one embodiment, the supports with the lowest elasticity coefficients are medial longitudinal support 848 and lateral longitudinal support 850, with transverse support 852 and heel support 854 registering elasticity coefficients roughly equal to that of the rest of arch support assemblage 442. Still other embodiments may, for example, provide the lowest elasticity coefficient levels around the entire perimeter of arch support assemblage 442, which comprises medial longitudinal support 848, lateral longitudinal support 850, transverse support 852, and heel support 854.

In one embodiment, only medial longitudinal support 848 will have a lower elasticity coefficient than each other part of the sock to account for the expectation that medial longitudinal support 848 will endure the greatest pressure while the user displays an erect posture.

In another embodiment, the perimetric supports may consist of varying elasticity coefficients generally based either on typical pressure expectations of the three arches and the distal heel region, or on the specific needs of persons with such aforementioned maladies as plantar fasciitis or a flat arch, among other maladies that would be known by those skilled in the art.

FIG. 8 depicts one embodiment of the arch support assemblage of a sock in accordance with the present invention. Hence, the support structure may be placed inside or on the outside of the sock without deviating from the scope of the present invention. Moreover, exemplary embodiments exist which do not require the exterior sock supports to have the same elasticity coefficients as their overlaid interior sock support counterparts. Instead, the interior supports may differ in elasticity coefficient from each other and from the supports of the exterior sock supports, though they need not differ for the proposed arch-supporting sock to be efficacious.

An arch-supporting sock has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

DESCRIPTION OF THE REFERENCE SYMBOLS

100: Foot
102: Fibula
104: Tibia
106: Talus
108: Navicular
110: Cuneiforms
112: Calcaneus
114: Cuboid
116: Metatarsals
118: Phalanges
220: Lateral ball
222: Medial ball
224: Transverse arch
226: Lateral longitudinal arch
228: Medial longitudinal arch
230: Arch region
250: Arch support assemblage
332: Heel
334: Flat arch
436: Sock
438: Sock leg
440: Heel flap
442: Arch support assemblage
444: Sock instep
446: Sock toe
848: Medial longitudinal support
850: Lateral longitudinal support
852: Transverse support
854: Heel support

What is claimed is:

1. An arch-supporting sock, comprising:

a first region, having a first elasticity coefficient; and a second region including an arch support assemblage for providing structural support to an arch of a foot, the arch support assemblage having a second elasticity coefficient that is lower than the first elasticity coefficient and defined by:

a first perimetric boundary that runs longitudinally along a middle portion of a sole of the sock between an outer region adapted to cover a lateral ball of the foot and an inner region adapted to cover a medial ball of the foot, so that the arch support assemblage substantially excludes the outer region of the sole of the sock;

a second perimetric boundary that runs substantially parallel to the first perimetric boundary and longitudinally along a border of an inner region of the sole of the sock adapted to cover a medial ball of the foot, so that the arch support assemblage partially covers the inner region of the sole of the sock;

a third perimetric boundary that runs substantially perpendicular to and between the first and second perimetric boundaries at a proximal region of a toe section of the sock, so that the arch support assemblage substantially excludes the toe section of the sock; and a fourth perimetric boundary that runs substantially perpendicular to and between the first and second perimetric boundaries at a distal region of a heel flap of the sock.

2. The sock of claim 1, wherein each of the perimetric boundaries that define the arch support assemblage between the first region and the second region comprise a perimetric elasticity coefficient, wherein the perimetric boundaries have a perimetric elasticity coefficient less than the first and second elasticity coefficients.

3. The sock of claim 2, wherein the perimetric boundaries between the first region and the second region are on the exterior of the sock.

4. The sock of claim 2, wherein the perimetric boundaries between the first region and the second region are on the interior of the sock.

5. The sock of claim 1, wherein the first region comprises terry loops.

6. The sock of claim 1, wherein the arch support assemblage is constructed using tuck-stitching.

7. An arch-supporting sock, comprising:

a first region having a first elasticity coefficient; and a second region having a second elasticity coefficient and including an arch support assemblage for providing structural support to an arch of a foot, wherein the arch support assemblage is defined by:

a first perimetric boundary that runs longitudinally along a middle portion of a sole of the sock between an outer region adapted to cover a lateral ball of the foot and an inner region adapted to cover a medial ball of the foot, so that the arch support assemblage substantially excludes the outer region of the sole of the sock;

a second perimetric boundary that runs substantially parallel to the first perimetric boundary and longitudinally along a border of an inner region of the sole of the sock adapted to cover a medial ball of the foot, so that the arch support assemblage partially covers the inner region of the sole of the sock;

a third perimetric boundary that runs substantially between the first and second perimetric boundaries at a proximal region of a toe section of the sock, so that the arch support assemblage substantially excludes the toe section of the sock; and a fourth perimetric boundary that runs substantially between the first and second perimetric boundaries at a distal region of a heel flap of the sock.

8. The sock of claim 7, wherein the second elasticity coefficient is higher than the first elasticity coefficient.

9. The sock of claim 7, wherein the perimetric boundaries comprise a perimetric elasticity coefficient that is less than the first elasticity coefficient.

10. The sock of claim 9, wherein the perimetric boundaries between the first region and the second region are on the exterior of the sock.

11. The sock of claim 9, wherein the perimetric boundaries between the first region and the second region are on the interior of the sock.

12. An arch-supporting, non-interchangeable left or right sock wherein proper curvature of the arch is reinforced and strain on the leg, arch, and greater foot area is decreased, comprising:

a first terry loop region having a first elasticity coefficient;

a second tuck-stitched region having a second elasticity coefficient and including an arch support assemblage for providing structural support, wherein the second elasticity coefficient is lower than the first elasticity coefficient the arch support assemblage defined by:

a first perimetric boundary that runs longitudinally along a middle portion of a sole of the sock between an outer region adapted to cover a lateral ball of the foot and an inner region adapted to cover a medial ball of the foot, so that the arch support assemblage substantially excludes the outer region of a sole of the sock;

a second perimetric boundary that runs substantially parallel to the first perimetric boundary and longitudinally along a border of an inner region of the sole of the sock adapted to cover a medial ball of the foot, so that the arch support assemblage partially covers the inner region of the sole of the sock;

a third perimetric boundary that runs substantially between the first and second perimetric boundaries at a proximal region of a toe section of the sock, so that the arch support assemblage substantially excludes the toe section of the sock; and a fourth perimetric boundary that runs substantially between the first and second perimetric boundaries at a distal region of a heel flap of the sock.

* * * * *